United States Patent [19]

Panetti

[11] 4,292,768

[45] Oct. 6, 1981

[54] GRINDING TOOL

[75] Inventor: Romolo Panetti, Geneva, Switzerland

[73] Assignee: Speno International S.A., Geneva, Switzerland

[21] Appl. No.: 88,833

[22] Filed: Oct. 29, 1979

[30] Foreign Application Priority Data

Nov. 9, 1978 [CH] Switzerland ..... 11526/78

[51] Int. Cl.[3] ..... B24D 5/00

[52] U.S. Cl. ..... 51/168; 51/209 R

[58] Field of Search ..... 51/168, 178, 209 R

[56] References Cited

U.S. PATENT DOCUMENTS

| | | | |
|---|---|---|---|
| 1,984,050 | 12/1934 | Beebe | 51/209 R |
| 2,108,630 | 2/1938 | Walker | 51/209 R |
| 2,118,409 | 5/1938 | Loewy | 51/209R |
| 2,616,229 | 11/1952 | Allison | 51/168 X |
| 2,616,230 | 4/1952 | Hough | 51/168 X |
| 3,256,646 | 6/1966 | Mockli | 51/209 R X |
| 3,656,393 | 4/1972 | Goellner | 51/168 X |

*Primary Examiner*—Gary L. Smith

*Attorney, Agent, or Firm*—Anthony J. Casella

[57] ABSTRACT

Tool comprising a support flange (1) fastened to the end of a drive shaft (2), a grinding wheel (6) which is integral with a metal plate (8) in which it is bonded and molded to shape, and a clamping flange (9) for clamping the plate of the grinding wheel against the support flange. Upon mounting, the plate (7) of the mold and the clamping flange (9) are centered around a collar (12) protruding from the support flange. The plate (7) of the grinding wheel is held in position before clamping by the simple engaging of the edges of two radial notches (14) below the retaining studs (16) of two spindles (15) of the support flange (1). Two locking spindles (19) which are rigidly secured to the clamping flange (9) angularly immobilize the assembly by engagement in two corresponding holes (17) of the support flange.

2 Claims, 5 Drawing Figures

11441 (2-2)

GRINDING TOOL

This invention relates to a grinding tool which is intended primarily, but not exclusively, for the grinding of the travel surfaces of the heads of railway rails.

The grinding tools used for this work are formed of a support flange mounted at the end of a drive shaft, a cylindrical grinding wheel, and a flange for clamping the mold against the support flange. Protective sectors, arranged on the periphery of the grinding wheel, are fastened to the support flange for safety.

When used on a railway track, this assembly constituting the grinding tool is displaced and guided mechanically along the surfaces to be ground by a suitable vehicle, the drive shaft which bears it being oriented in a direction perpendicular to a tangent to the transverse profile of the head of the rails, so as to cause the free face of the grinding wheel to act. In the shop, the rail is displaced and guided mechanically beneath the grinding tool, but the grinding work is identical.

These grinding tools are satisfactory in use, both on the track and in the shop, but they raise problems of maintenance upon replacement of a grinding wheel on its support flange, particularly on the track grinding vehicles. In these vehicles the operator, who is in a uncomfortable squatting position or else lying on his back when the grinding wheel must be mounted on a substantially vertical drive shaft, must place the grinding wheel in position against the suppot flange, place the clamping flange against the grinding wheel within the latter, and finally lock the clamping flange by means of screws or bolts, while continuously retaining the mold and the clamping flange in position. This uncomfortable operation is lengthy, exhausting, and not without danger, since the grinding wheel, which is heavy and has rough edges, may be let go, inadvertently or due to fatigue, and injure the operator. Furthermore, in these uncomfortable working positions it is difficult for the operator to assure a controlled and uniform tightening of the clamping screws or bolts and this may create dangerous stresses in the abrasive material constituting the mold, the mold being fragile.

As defined in claim 1, the grinding tool of the invention provides a solution to these problems by the fact that the attaching and removal of the clamping flange can be effected without having to hold the grinding wheel at the same time, the wheel being held in position during these operations by the centering and retaining elements of the plate of the grinding wheel and the support flange, and by the fact that, as the locking of the grinding wheel into position is effected by clamping its plate alone onto the support flange, no dangerous stresses can be created in the abrasive material in case of too strong a clamping.

The accompanying drawing shows one embodiment of the object of the invention by way of example, as well as a variant of one of its component elements.

Figure 1:
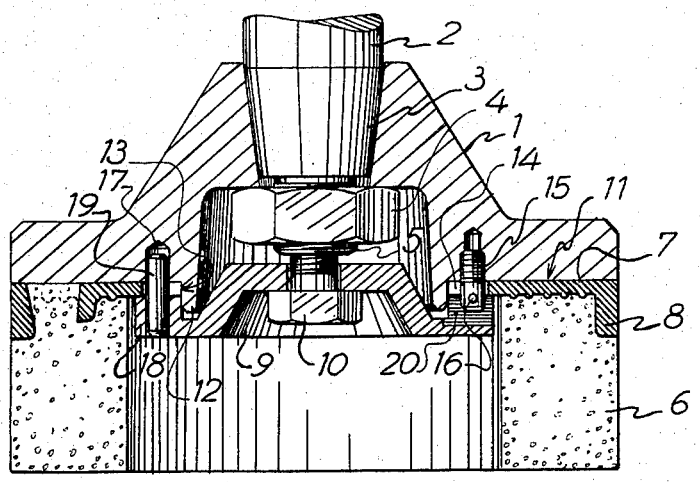
FIG. 1 is an overall view in a broken axial section through an embodiment given by way of example.

The grinding tool shown in FIG. 1 comprises:

a metal support flange 1 fastened to the end of a drive shaft 2 on a frustoconical portion 3 thereof on which it is force-fitted and keyed and then locked by a lock nut 4 in engagement with the threaded end 5 of the said drive shaft 2, a cylindrical grinding wheel 6 of abrasive material bound rigidly to and forming a single body with a metal plate 7 having the shape of a circular crown with partial covering yoke 8 in which said abrasive material is bonded and molded to shape, a flange 9 for clamping the plate 7 of the grinding wheel against the suppot flange 1, it being clamped by a central screw 10 in engagement in an axial threaded hole concentric with the threaded end 5 of the drive shaft 2.

Figure 2:
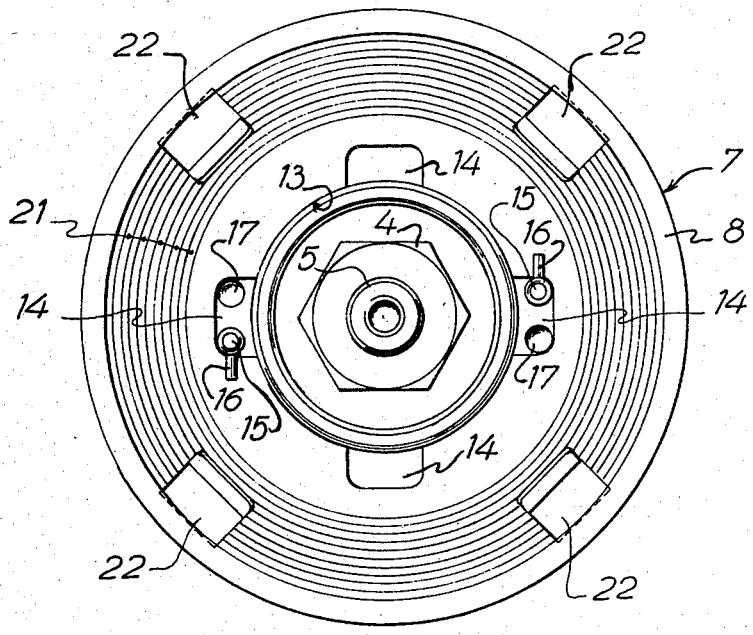
FIG. 2 is a partial bottom view thereof.

The support flange 1 has a flat face 11 in the shape of a circular crown against which the plate 7 of the grinding wheel comes to rest over its entire surface. This flat face 11 is limited in its central portion by a protruding cylindrical centering collar 12 on which there is engaged a circular opening 13 of the plate 7, clearly visible in FIG. 2 in which the grinding wheel 6 and the clamping flange 12 have not been shown in order to assure greater clarity. The plate 7 is provided on the periphery of said opening 13 with four radial notches 14 of semi-rectangular shape arranged 90° apart from each other and of the same dimensions.

The support flange 1 has two spindles 15 with retaining studs 16 arranged in diametrically opposite positions and two cylindrical holes 17 adjacent these two spindles, the walls of each of these two spindles and of its adjacent hole being arranged directly above and within the contour of a notch 14 of the plate 7.

The spindles 15 equipped with their retaining studs 16 have a total width which is less than the width of the notches 14 so as to permit their passage into the latter upon the putting in position of the plate 7 on the support flange 1. The retaining of the plate in position is assured by a slight rotation of the plate, which has the effect of engaging one edge of the notches 14 below the retaining studs 16 of the spindles 15.

Figure 3:
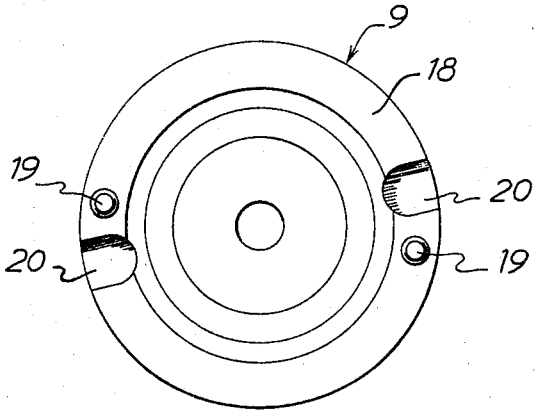
FIG. 3 is a top view of one of its component elements.

The clamping flange 9, shown also in top view in FIG. 3, comprises a cylindrical boss 18 which comes to bear against the free central portion of the plate 7 and laterally against the centering collar 13 of the support flange 1. Two angular locking spindles 19 for the plate 7 are arranged on this clamping flange 9 in diametrically opposite position above the two holes 17 of the support flange 1 so that once engaged in these holes upon the positioning of the clamping flange 9, these spindles 19 cooperate with the two spindles 15 of the support flange 1 to take up the entire width of the two notches 14 which they intercept and thus immobilize angularly the plate 7 on the support flange 1. Two recesses 20 are provided in the immediate vicinity of the spindles 19 in the cylindrical boss 18 above the retaining spindles 15–16, which place themselves therein upon assembly.

The plate 7 is provided, over the entire surface thereof bonded to the abrasive material constituting the grinding wheel 6, with elements for the hooking of said material which are formed by a plurality of circular rims 21 with rough surface and rounded cross section and by four openings 22 with tapered walls, one of which is shown in cross section in FIG. 1. These hooking elements cooperate with the covering yoke 8 to distribute the resistant and driving torques throughout the mass of the abrasive material constituting the grinding wheel 6 and to increase the adherence of the latter to the plate 7.

Figure 4:
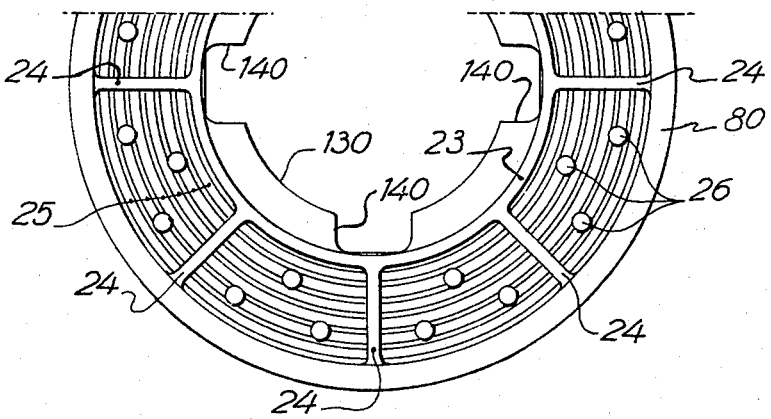
FIG. 4 is a partial bottom view of the variant.
Figure 5:
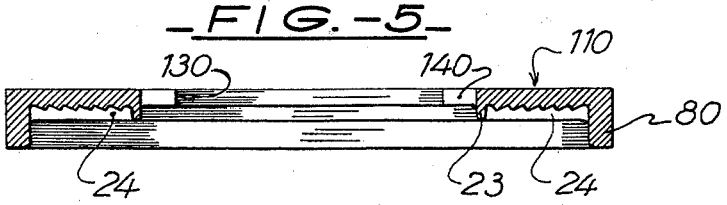
FIG. 5 is an axial section through same.

A variant of this plate, intended more particularly for grinding tools which are to be subjected to very strong stresses, is shown in FIGS. 4 and 5.

Like the one already described, this plate has a flat face 110 intended to bear against the support flange 1, an outer partial covering yoke 80, a circular central opening 130 intended for its centering on the collar 12 of the support flange 1, and four notches 140 intended to cooperate with the spindles 15 and 19 of the support and clamping flanges for the retaining and angular immobilizing thereof. This plate is distinguished from the preceding one by a different design of its hooking elements. In this case, these elements consist of a second small inner covering yoke 23 connected to the outer yoke 80 by radial stiffening walls 24, defining between themselves segments the bottom of which has circular rims 25 of rough surface and triangular cross section presenting an abrupt wall directed towards the center of the plate. Protruding pins 26 coming from the casting holes of the metal constituting the plate are left visible so as further to increase the number of hooking elements, whereby the assembly thus formed gives a better distribution of the resistant and driving torques throughout the mass of the abrasive material of the grinding wheel, and a better adherence.

Furthermore, the replacement of the tapered openings 22 of the first plate described by the inner yoke 23 and by the radial stiffening walls 24 of said variant permits a better balancing of the shapes and makes it possible to obtain better planarity of the plate after molding.

Other variations may be made in the embodiment of the grinding tool in accordance with the invention.

Thus, the number of notches 14 of the plate 7 of the grinding wheel can be limited to two.

The retaining and centering elements of the plate 7 may be different, for instance elastic clips, provided that they operate by simple engagement.

The hooking elements for the abrasive material of the grinding wheel can be formed and combined differently with each other.

Finally, the grinding tool described can be applied to all grinding jobs in addition to those relating to the grinding of the travel surfaces of railway rails, to the extent that such jobs raise comparable problems.

What is claimed is:

1. A grinding tool comprising:

(a) a support flange means adapted to be fastened to the end of a drive shaft;

(b) a cylindrical grinding wheel formed of a yoke-shaped plate means having abrasive material bonded and molded to shape therein;

(c) a clamping flange means for clamping said grinding wheel on said support flange means;

(d) retaining stud spindle means arranged on said support flange means;

(e) hole means located on said support flange means in the vicinity of said retaining stud spindle means;

(f) notch means arranged in said plate means for surrounding engagement over said retaining stud spindle means and said hole means; and (g) locking spindle means on said clamping flange means for engagement within said notch means and said hole means.

2. A grinding tool comprising:

(a) a support flange means adapted to be fastened to the end of a drive shaft;

(b) a cylindrical grinding wheel formed of a yoke-shaped plate means having abrasive material bonded and molded to shape therein;

(c) a clamping flange means for clamping said grinding wheel on said support flange means;

(d) two spindles with retaining studs arranged in diametrically opposite positions on said support flange means;

(e) two holes located in said support flange means in the vicinity of said spindles with retaining studs;

(f) two notches arranged in said plate means, each of said notches having an inside contour adapted to surround one of said spindles and the adjacent hole; and (g) two locking spindles on said clamping flange means for respective engagement within said notches and holes.

* * * * *